United States Patent [19]

Wlodkowski et al.

[11] 4,410,162

[45] Oct. 18, 1983

[54] RECOVERABLE FORM PART FOR USE IN THE REGION WHERE A TENDON IS ANCHORED IN A PRESTRESSED CONCRETE COMPONENT

[75] Inventors: Johann Wlodkowski; Oswald Nützel; Dieter Jungwirth, all of Munich, Fed. Rep. of Germany

[73] Assignee: Dyckerhoff & Widmann Aktiengesellschaft, Munich, Fed. Rep. of Germany

[21] Appl. No.: 291,037

[22] Filed: Aug. 7, 1981

[30] Foreign Application Priority Data

Aug. 16, 1980 [DE] Fed. Rep. of Germany ..... 3030975

[51] Int. Cl.[3] ..... E04G 17/08

[52] U.S. Cl. ..... 249/215; 249/216

[58] Field of Search ..... 249/43, 46, 183, 184, 249/213, 190, 216, 215

[56] References Cited

U.S. PATENT DOCUMENTS

| | | | |
|---|---|---|---|
| 3,676,031 | 7/1972 | Stinton | 249/43 |
| 3,685,934 | 8/1972 | Huber | 249/43 |
| 3,822,860 | 7/1974 | Lovisa | 249/190 |
| 3,907,244 | 9/1975 | Abbott | 249/46 |
| 3,918,673 | 11/1975 | Abbott | 249/216 |
| 4,027,847 | 6/1977 | Johnson | 249/190 |

*Primary Examiner*—John A. Parrish

*Attorney, Agent, or Firm*—Toren, McGeady and Stanger

[57] ABSTRACT

In a recoverable form for use in the region where a tendon is anchored in a prestressed concrete component, a part is provided for forming a cup-shaped recess in the concrete surface. The part contains an axially extending passage through which a tendon extends. The part is formed of rubber or a rubber-like material and is constructed so that its outer surface extending in the direction of the passage arches outwardly away from the passage when a compressive force is applied to the part in the axial direction of the passage.

8 Claims, 9 Drawing Figures

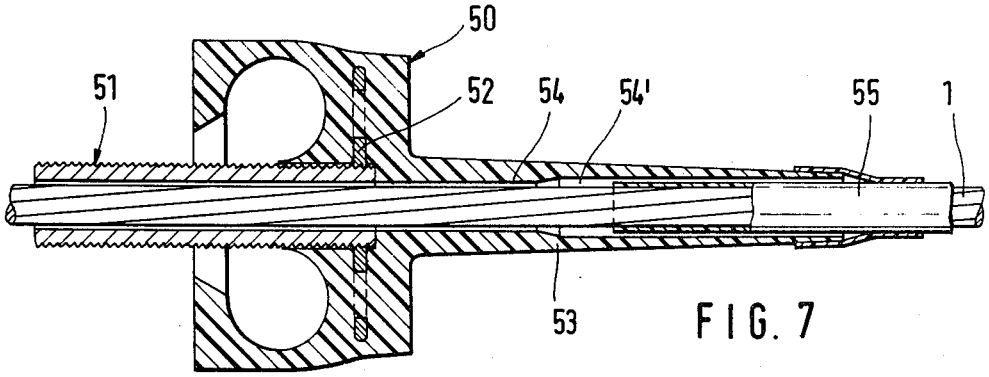
FIG. 7
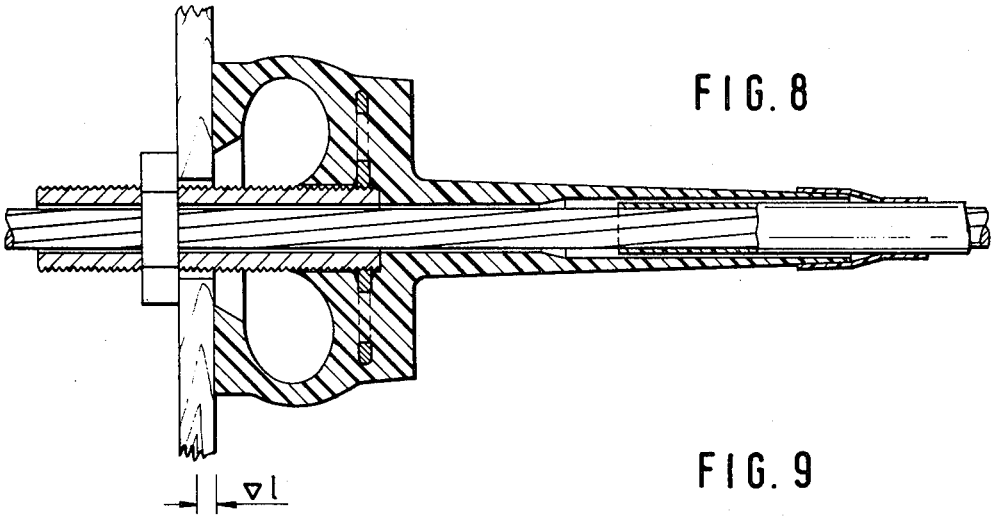
FIG. 8
FIG. 9
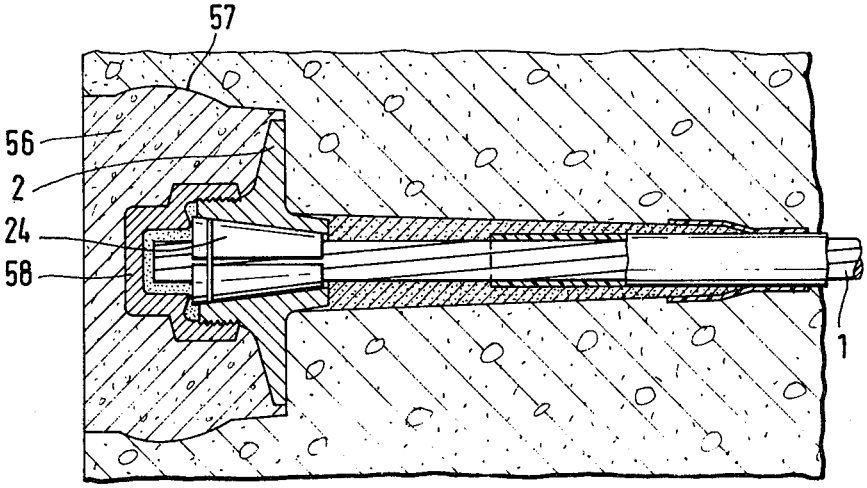

RECOVERABLE FORM PART FOR USE IN THE REGION WHERE A TENDON IS ANCHORED IN A PRESTRESSED CONCRETE COMPONENT

SUMMARY OF THE INVENTION

The present invention is directed to a part of a removable or recoverable form for use in the region where a tendon is anchored in a prestressed concrete component and, more particularly, to a part which forms a cup-shaped recess within the concrete with a passage through the part through which a tendon extends.

In the assembly of tendons within a prestressed concrete member or component, which tendons are tensioned after the concrete has been poured and set, care must be taken that the anchoring members are accessible after the concrete has set so that tensioning devices can be applied and to position the anchoring parts. To protect the individual elements of the anchoring means in the same way that the tendon is protected against corrosion, it is customary to locate the anchoring means at a distance inwardly from the outer edge of the concrete component and to provide a recess around the anchoring means which widens outwardly to the periphery of the component and subsequently fill the recess with grout after the tendon has been tensioned.

To provide such a recess and at the same time afford an attachment for an anchoring member, it is known to provide, as part of the formwork, a part which forms a recess so that a thread is supplied into which an anchoring member can be screwed. Further, the part includes an external thread which forms a contact surface with the formwork. Such a tube penetrates the formwork along with the tendon and can be fixed with the tendon by a nut located on the exterior of the formwork, note German Offenlegungsschrift No. 19 58 448. Such a recess-forming part is made of a plastics material of sufficient strength to form a screw thread. After the concrete has set, the part is removed from the anchoring member and leaves a recess.

Parts of this type used for forming the recess are of a conical construction to facilitate their removal from the concrete after it has set. In spite of their shape, it is often not easy to strip these parts from the concrete without causing some damage. If the conical shape of the recess leaves smooth walls corresponding to the exterior shape of the part, there is the disadvantage that mortar filled into the recess is not adequately anchored.

Therefore, it is the primary object of the present invention to provide a recess in the region in which a tendon is anchored which provides an undercut section for assuring adequate securement of the mortar placed in the recess.

In accordance with the present invention, the part used to form the recess is made of an elastically deformable material such as rubber or a rubber-like material and is shaped so that when the part is axially compressed it expands radially outwardly forming an undercut recess in the concrete surrounding the surface of the part.

Preferably, the interior of the part is provided with a toroidally shaped open section laterally surrounding a passage through which the tendon extends so that an axially compressive force acting on the part causes the outside surfaces of the part to project outwardly.

It is known to form recesses in concrete components by inserting hollow form elements made of rubber which are closed laterally and are deformable so that the part can be stripped after the concrete is set, note French patent 1,423,536. Further, it has also been suggested to use a synclinal part of an elastically deformable material for forming recesses in which tendons are anchored. Such a synclinal part is closed by a cover at its open side directed toward the formwork, note German Offenlegungsschrift No. 30 14 624. This part merely serves to provide a recess in its original form and is deformed when the form is stripped.

The advantage of the presnt invention is particularly directed to the use of a recess-forming part constructed as an elastically deformable material to which an axially compressive force is applied while the concrete is poured and set so that the part deforms laterally outwardly providing a circumferentially extending protuberance or enlargement. After the concrete has set, the axially compressive force can be removed so that the force causing the outward deformation is released with the recess-forming part returning to its initial shape due to its natural elasticity so that the part virtually bounces out of the opening or recess it has created in the surface of the concrete component.

In addition, because of the outward deformation of the recess-forming part, the effect of which can be increased by providing a toroidal hollow space within the interior of the part, an undercut groove is provided in the surface of the recess formed by the part so that cement mortar filled into the recess is firmly secured.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWING

FIG. 7 is a longitudinal sectional view similar to FIGS. 1 and 4, illustrating the region for anchoring a tendon and displaying another embodiment of the part for forming a recess in the concrete component;

FIG. 8 is a longitudinal sectional view similar to FIG. 7 with the recess-forming part assembled within the formwork and experiencing axial compression; and FIG. 9 is a longitudinal sectional view similar to FIG. 7, however, showing the concrete poured and set and with the recess forming part stripped out of the concrete component.

DETAILED DESCRIPTION OF THE INVENTION

Figure 1:
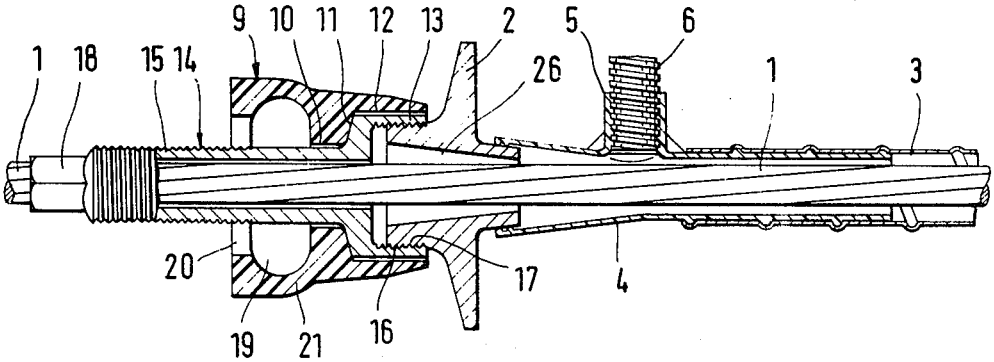
FIG. 1 is a longitudinal sectional view of the region in which a tendon is anchored in forming a concrete component with a part arranged to form a recess in the concrete component.
Figure 2:
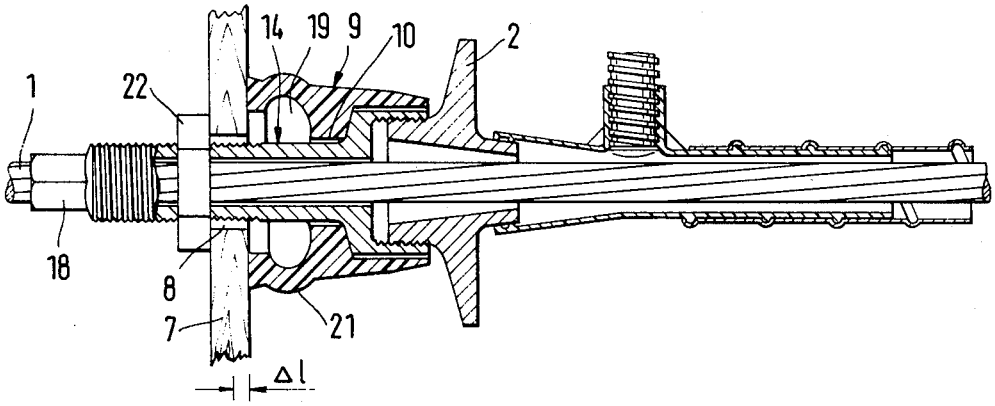
FIG. 2 is a sectional view similar to FIG. 1, however, showing the structure of FIG. 1 assembled and secured within formwork.
Figure 3:
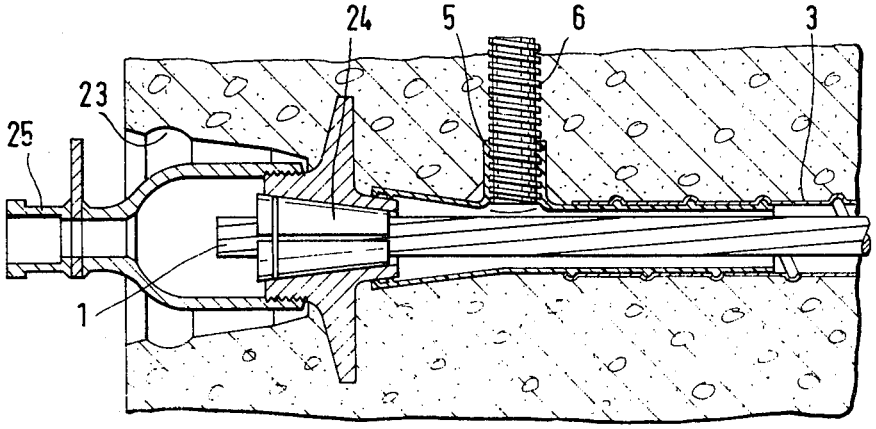
FIG. 3 is another longitudinal sectional view similar to FIG. 1, however, illustrating the concrete component after the concrete has set with the formwork stripped.

In FIGS. 1, 2 and 3 the structure embodying the present invention is shown at the location at which a tendon for a prestressed concrete component is secured to an anchoring member with the tendon arranged for post tensioning with FIGS. 1 and 2 illustrating the assembled condition of the formwork before and after an axial compression is supplied to the recess-forming part and with FIG. 3 showing the concrete component after it has been poured and set with the formwork stripped and the recess-forming part removed.

The region where the tendon is anchored, shown in FIGS. 1–3, includes a tendon or strand 1 extending through an anchoring member 2 to be embedded in concrete. In FIGS. 1 and 2, the anchoring member is shown held in position by the formwork prior to the pouring of the concrete, while FIG. 3 shows the concrete component after it has been formed with the anchoring member secured to the concrete. The strand 1 extends through the concrete component within a tubular sheath 3 which is connected to the anchoring member 2 by a transition piece 4 conically widening outwardly from the sheath to the adjacent end of the anchoring member. The anchoring member 2 has a centrally arranged passage 26 through which the strand 1 extends. The transition piece 4 includes a transversely extending pipe stub 5 to which a ventilation or injection hose 6 can be connected, after the strand has been tensioned, for pumping a cement grout between the strand 1 and the tubular sheath 3 which has been embedded in the concrete.

The strand 1 extends from the anchoring member 2 through opening 8 in the form 7, note FIG. 2. Encircling the strand 1 between the anchoring member and the inner face of the form is a part 9 configured to provide a cup-shaped recess in the surface of the concrete component after the concrete has been poured. The recess-forming part 9 is made of an elastically deformable material such as rubber, plastic or the like and its exterior configuration is such that it forms a cup-shaped recess when it is eventually stripped from the concrete component. A centrally arranged passage 10 extends through the part 9 providing an opening for the strand extending between the anchoring member 2 and the opening 8 in the form 7.

At the side of the part 9 facing toward the anchoring member 2, the passage 10 is widened and forms an opening 12 having a frusto-conical supporting surface 11 facing toward the anchoring member. A spindle guard tube 14 extends through the recess-forming part 9 with the inner end 13 of the tube widening to correspond to the shape of the opening 12 with a frusto-conical surface on the tube corresponding to and bearing against the supporting surface 11 in the opening 12. Tube 14 has an outer end 15 with an external thread. The end 15 of the tube 14 extends through the opening 8 in the form 7. The tube 14 laterally encircles and forms a guide for the strand 1. In the region of the widened portion 13 of the guard tube 14 an internal thread 16 is provided into which a corresponding external thread 17 on the anchoring member 2 can be screwed. To provide the requisite rotary motion for effecting the threaded connection, the spindle guard tube 14 has a hexagon head 18 formed at its outer end outwardly from the form 7.

The recess-forming part 9 has surfaces extending transversely of the axial direction of the strand 1 and the passage through the tube 8 containing the strand and a surface extending between these transversely extending surfaces from the anchoring member 2 to the inside surface of the form 7. Radially inwardly of this surface extending between the anchoring member and the form is a hollow toroidal space 19 which extends radially outwardly from the passage 10 to a location spaced inwardly of the surface of the part 9. An opening 20 extends in the axial direction of the strand 1 from the toroidal space 19 to the surface of the form 7, note FIG. 2. A wall 21 forms a part of the surface extending between the anchoring member 2 and the form 7 and separates the space 19 from the exterior of the part 9. As compared to FIG. 1, in FIG. 2 it can be seen that when axial compression is applied to the part 9, the wall 21 arches outwardly forming a bulge or projection so that there is a deformation of the part 9 in the direction extending transversely of the axial direction of the strand 1.

In the assembled condition, the recess-forming part is located between the anchoring member 2 and the form 7 and encircles the spindle guard tube 14, note FIG. 2. A nut 22 is threaded onto the tube 14 and bears against the outside surface of the form 7. By applying a sufficiently large torque through this nut 22, the part 9 between the form 7 and the anchoring member 2 is compressed in the axial direction of the strand by a distance $\Delta 1$ with the wall 21 arching outwardly as a result of the deformation. After the concrete has been poured and set within the form 7, the nut 22 is loosened and removed so that the form 7 can be removed. When the form 7 is stripped, the recess-forming part tends to rebound or return, due to its inherent elasticity, to its original shape. When this occurs, the part tends to loosen itself from the concrete so that it can be easily removed from the recess it has formed in the surface of the concrete.

In FIG. 3 the strand 1 is shown after it has been tensioned. The tension is transferred by means of a tapered collar 24 to the anchoring member 2. The recess formed by the part 9 serves to fit an injection hood 25 over the end of the anchoring member 2 within the recess 23. By means of the injection hood 25 the hollow space between the strand 1 and the tubular sheath 3 can be filled with a cement grout. Subsequently, the recess 23 is filled with concrete.

Figure 4:
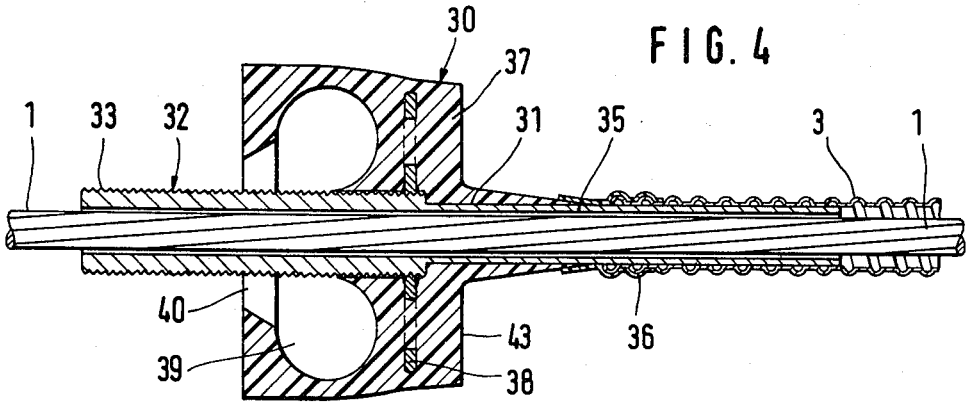
FIG. 4 is a longitudinal sectional view similar to FIG. 1, however, illustrating another embodiment of the part for forming a recess in the concrete component.
Figure 5:
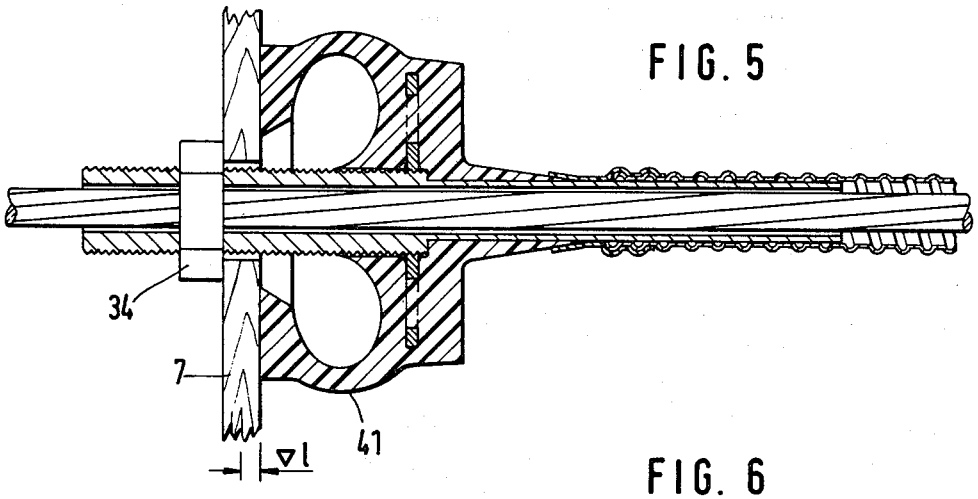
FIG. 5 is a longitudinal sectional view similar to FIG. 4 with the recess-forming part being axially compressed.
Figure 6:
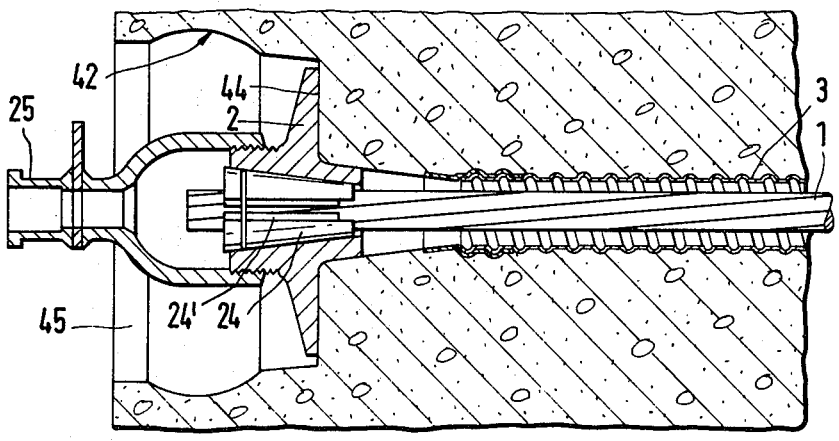
FIG. 6 is a longitudinal sectional view similar to FIG. 4 after the concrete has been poured and set and with the formwork stripped.

In FIGS. 4, 5 and 6 another embodiment of the recess-forming part is shown for producing a recess into which an anchoring member for the strand can be placed subsequent to the formation of the concrete component.

As can be seen in FIG. 4, recess-forming part 30 provides a cup-shaped recess. A passage 31 extends through the part 30 in the axial direction of the strand 1 and is closed by an outer portion 33 on which an external thread is provided onto which an anchoring nut 34 can be screwed, note FIG. 5. On the opposite or inner side of the part 30, the spindle guard tube continues as an extension 35 having a smaller diameter for connection into the tubular sheath 3. The extension 35 can be pushed into the tubular sheath 3. The transition provided by the extension 35 can be sealed by a sealing band 36, note FIG. 4. A disc-shaped anchoring part 38 is embedded in the base of the recess-forming part 30, that is, in the inner portion of the part relative to the form 7. The anchoring part 38 can be vulcanized into the part 30. Anchoring part 38 is firmly connected to the spindle guard tube 32, such as by welding. This firm connection can also be effected by a threaded connection or by a connection of the slide lock type.

Recess-forming part 30 has a toroidal hollow space 39 and an opening 40 extends from the hollow space to the inside surface of the form 7, note FIG. 5. As in the previous embodiment, this hollow space 39 provides a reduced thickness wall section surrounding the hollow space so that an arched-like bulge or projection is developed outwardly from the hollow space when axial compression is applied to the part 30. By comparing FIGS. 4 and 5, the deformation outwardly of the hollow space 30 can be noted affording the arch-like projection 41.

In FIG. 6 the anchoring of the strand 1 is shown after the concrete component has been poured and set and the form 7 removed. Because of the construction of the part 30, the inner surface extending transversely of the strand 1 is arranged exactly perpendicularly to the strand axis affording a support surface 44 for the anchoring member 2. The anchoring member 2 can be inserted into the recess 45 formed by the part 30 after the form has been stripped. The hollow space between the strand 1 and the tubular sheath 3 can be filled by means of an injection hood 25 placed over the outer end of the anchoring member 2. To provide flow of grout forced into the space between the strand and the tubular sheath, axially extending ducts 24' are formed in the tapered collar 24 so that the grout can flow from the hood 25 through the anchoring member 2 into the sheath 3. In FIGS. 7, 8 and 9 another embodiment of a tendon anchor is illustrated where there is no bonding between the tendon and the surrounding concrete of the component.

In this embodiment, a recess-forming part 50 is provided which is basically of the same construction as the part 30 in FIGS. 4 and 5. A spindle guard tube 51 extends within the part 50 only to the anchoring part 52, however, the part 50 continues inwardly in the form of a reduced diameter extension 53 continuously narrowing inwardly and extending into a covering 55 enclosing the strand 1. The interior of the extension 53 extending from the main section of the part 50 has an inside diameter the same as the inside diameter of the tube 51, however, its diameter increases in an expanded section 54'. The covering 55 serves as corrosion protection and extends into the expanded section 54'. The length of the extension 53 and of the widened section 54' must be sufficient to absorb any possible shrinkage of the covering 55 on the strand. The covering 55 may be a polyethylene hose.

After the strand 1 is tensioned and anchored within the anchoring member 2 by a tapered collar 24, the open space formed by the recess-forming part is filled with a cement mortar 56 which is held securely within the recess due to the undercut wall 57 provided by the arched configuration of the part 50 when it is axially compressed. The end of the strand 1 is protected by a cap 58 filled with a corrosion protection substance. The cap 58 is screwed onto the anchoring member 2.

While specific embodiments of the invention have been shown and described in detail to illustrate the application of the inventive principles, it will be understood that the invention may be embodied otherwise without departing from such principles.

We claim:

1. Recoverable form part for use in the region where a tendon is anchored in a concrete component, comprising a part having a configuration so that it forms a cup-shaped recess when attached to the portion of the form into which concrete is poured, said part having an interior surface forming a centrally arranged passage therethrough for the tendon, said part is formed of a resilient material such as rubber or a rubber-like material, said part having first outer surfaces extending transversely of the passage therethrough with said first outer surfaces being spaced apart in the axial direction of the tendon and at least one second outer surface extending between said first outer surfaces and extending generally in the direction of the passage therethrough, a spindle guard tube is arranged within said part extending into and being concentric with the passage through said part with said interior surface closely encircling said tube, said tube extending into said part from the side of said part arranged to contact the surface of the form, said tube is arranged to extend through the form so that an axially compressive force can be applied through said tube to said part, said part has an annular hollow space therein laterally encircling said spindle guard tube adjacent to and spaced from the end of said part arranged to contact the form, said hollow space extends radially outwardly from said interior surface to an annular location spaced inwardly from said second outer surface, said part has an annular opening extending around said spindle guard tube and from the hollow space to said first surface thereof arranged to contact the form, said annular opening extends radially outwardly from said interior surface to a surface spaced radially inwardly of the radially outermost surface of said hollow space, the portion of said part forming said second outer surface and laterally encircling said hollow space having a reduced thickness wall section as compared to the adjacent wall sections of said outer surface extending in the direction between said first outer surfaces and the reduced thickness wall section is spaced from said first outer surfaces so that said portion deforms outwardly from said passage when a compressive force is applied to said part in the direction of said passage whereby said portion of said second outer surface arches outwardly away from said passage relative to the remainder of said second outer surface.

2. Recoverable form part, as set forth in claim 1, wherein the end of said spindle guard tube extending outwardly from said part and arranged to extend through the form has an external thread thereon, and a nut threaded onto said tube and arranged to contact said form for applying compressive force to said part.

3. Recoverable form part, as set forth in claim 1 or 2, wherein said hollow space in said part has a toroidal form.

4. Recoverable form part, as set forth in claims 1 or 3, wherein said spindle guard tube terminates within said part and the end thereof within said part is radially widened forming an annular supporting surface arranged to bear against a correspondingly shaped surface within said part.

5. Recoverable form part, as set forth in claims 1 or 2, wherein an anchoring part is embedded within the section of said part adjacent the first surface thereof spaced from the first surface arrange to contact the form.

6. Recoverable form part, as set forth in claim 5, wherein said spindle guard tube is connected to said anchoring part.

7. Recoverable form part, as set forth in claim 6, wherein said anchoring part is vulcanized to the section of said part within which it is located.

8. Recoverable form part, as set forth in claim 6, wherein said spindle guard tube is welded to said anchoring part.

* * * * *